United States Patent [19]

Hutson et al.

[11] Patent Number: 5,057,030

[45] Date of Patent: Oct. 15, 1991

[54] GROMMET/SEAL MEMBER FOR A CONNECTOR ASSEMBLY

[75] Inventors: Russell W. Hutson, Woodburn; Dennis W. Buhro, Kendallville; Nicholas S. Hodgman; Brian T. Wright, both of Fort Wayne, all of Ind.

[73] Assignee: ITT Corporation, New York, N.Y.

[21] Appl. No.: 547,789

[22] Filed: Jul. 2, 1990

[51] Int. Cl.[5] ..... H01R 13/73

[52] U.S. Cl. ..... 439/247; 439/567; 439/606

[58] Field of Search ..... 439/552–556, 439/559, 567, 247, 248, 252, 606, 936, 736, 276, 587, 588; 174/153 R, 153 G

[56] References Cited

U.S. PATENT DOCUMENTS

| | | | |
|---|---|---|---|
| 2,774,812 | 12/1956 | Clark | 439/736 |
| 2,800,526 | 7/1957 | Moorhead | 439/449 |
| 2,988,725 | 6/1961 | Vallee | 439/556 |
| 3,457,441 | 7/1969 | Phillips et al. | 439/271 |
| 3,495,028 | 2/1970 | Tutthill | 439/559 |
| 3,502,917 | 3/1970 | Bizoe | 174/153 G |
| 3,770,878 | 11/1973 | Dozier | 439/559 |
| 3,824,328 | 7/1974 | Ting et al. | 174/52.2 |
| 3,954,318 | 5/1976 | Larson et al. | 439/248 |
| 3,997,760 | 12/1976 | Salinger | 174/153 G |
| 4,480,151 | 10/1984 | Dozier | 439/544 |

FOREIGN PATENT DOCUMENTS

| | | | |
|---|---|---|---|
| 1665408 | 3/1971 | Fed. Rep. of Germany | 439/559 |
| 813730 | 6/1937 | France . | |

*Primary Examiner*—Gary F. Paumen

*Attorney, Agent, or Firm*—Barnes & Thornburg

[57] ABSTRACT

A connector assembly includes a connector body having at least one terminal, an electrical conductor connected to and extending away from the terminal, and a one-piece, molded grommet/seal member. The grommet/seal member is injection-molded around a portion of the connector body, the point at which the electrical conductor and terminal are connected, and at least a portion of the electrical conductor. A portion of the grommet/seal member is formed so as to sealingly attach to an opening in a housing. The grommet/seal member is formed of a flexible material, such as neoprene, so as to allow the connector body to be laterally displaced for purposes of alignment with a mating connector assembly.

14 Claims, 1 Drawing Sheet

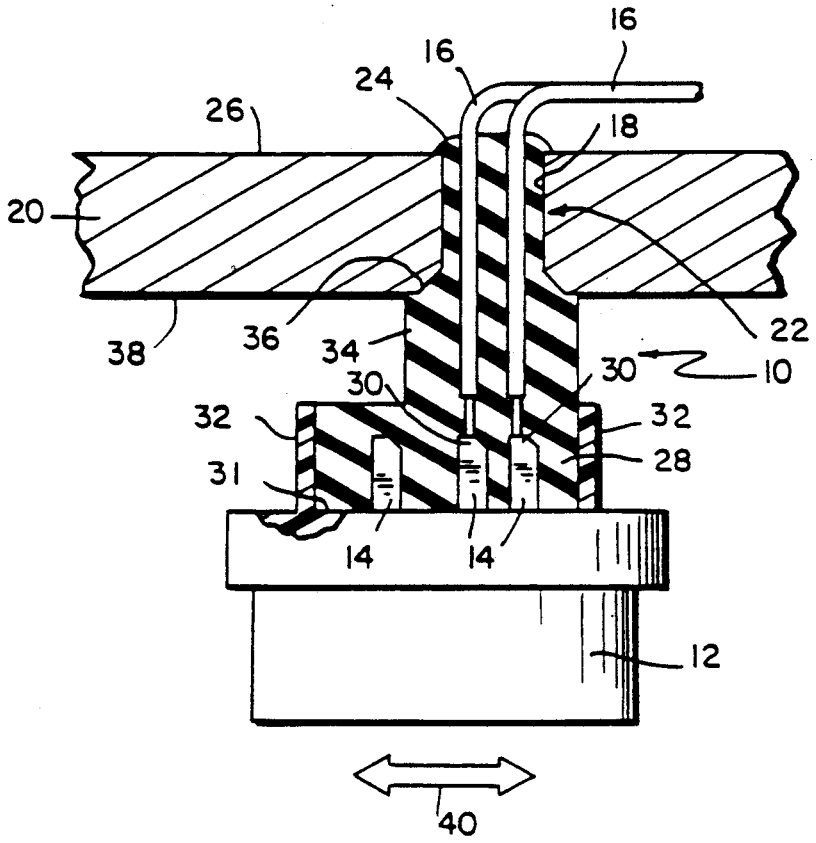
16
16
24
26
18
20
22
38
36
34
30
10
30
32
32
28
31
14
14
12
40

GROMMET/SEAL MEMBER FOR A CONNECTOR ASSEMBLY

BACKGROUND AND SUMMARY OF THE INVENTION

This invention relates generally to an arrangement for attaching a connector assembly, or similar structure, to a housing and to an electrical conductor which extends through an opening in the housing. More specifically, this invention relates to a one-piece, non-rigid grommet/seal assembly for sealing an opening in a housing and for protecting an electrical conductor which extends through the opening.

In situations where electrical devices are enclosed in housings, it often becomes necessary to extend one or more electrical conductors through openings in the housings for attachment to terminal points on a variety of devices. The openings for such conductors provide, if not adequately sealed, a means for the ingress moisture and other contaminants into the housings. In addition, moisture may also travel into an enclosure through the conductors by "wicking" along the wires or between the wires and the overlying insulation.

Another potential problem which arises when electrical conductors are routed through openings in metallic housings relates to the integrity of the insulation provided on such conductors. If the conductors contact and rub against edge surfaces of the openings in the housings, the insulation on the conductors can become frayed, nicked or otherwise damaged. Such damage may cause electrical short-circuits and cause additional difficulties in the maintenance of an effective seal at the opening.

One approach to these problems involves the use of various potting compounds, such as an "RTV" silicon-based adhesive, to encapsulate the conductors and fill the subject opening in the housing, and to encapsulate and seal the connection or termination points of the conductors to prevent wicking. However, this approach is not entirely satisfactory. Certain types of wire insulation (e.g., Teflon insulation) is difficult to seal using conventional potting compounds or adhesives. In addition, the application or assembly time and the adhesive cure times can be excessively long.

It is an object of this invention to provide an improved arrangement for sealing an opening in a housing through which electrical conductors pass, and for protecting the conductors from unintended contact with the edges of the opening.

It is a further object of this invention to provide an arrangement for sealing an opening through which one or more electrical conductors pass which may be more efficiently and effectively installed in the opening.

Still yet another object of the present invention is to provide an improved arrangement for sealing an opening and protecting a conductor which utilizes a preformed grommet/ seal member.

These and other objects are achieved in an arrangement for sealing an opening in a housing, and for sealing and protecting an electrical conductor which extends through the opening, which comprises a grommet/seal member having a first portion which extends into the opening and which has a surface which matingly seals against an adjacent surface of the housing, a second portion spaced apart from the opening in the housing and encapsulating an exposed end of the electrical conductor, and a third portion connecting the first and second portions. The electrical conductor extends from the second portion of the grommet/seal member through the third and first portions to enter the housing without exposure to moisture or other environmental contaminants. The first portion is provided with a flared end which extends adjacent an interior surface of the housing so as to prevent removal of the grommet/seal member from the opening. The third portion has a cross-section which is substantially larger than the opening and a surface which extends adjacent an exterior surface of the housing to prevent the assembly from being pushed through the opening in the housing. The grommet/seal member preferably comprises a unitary structure formed of a molded, non-rigid material such as neoprene.

In a particularly preferred embodiment, the grommet/seal member forms part of a connector assembly which includes a connector body having at least one terminal. The electrical conductor connects to the terminal at a connection point near the connector body, and extends away from the connection point through an opening in the housing. The grommet/seal member is molded onto the connector body so as to encapsulate the connection point and at least a portion of the electrical conductor. A portion of the grommet/seal member is provided with means for sealingly mounting to the opening in the housing so as to prevent the ingress of water and other contaminants through the opening and along the conductors. The one-piece, molded grommet/seal member is relatively flexible so as to allow the connector assembly to be laterally displaced and aligned with a mating connector assembly. The grommet/seal member is preferably molded to a portion of the connector assembly and is formed from a material such as neoprene.

Other objects, advantages and novel features of the present invention will become apparent from the following detailed description of the invention when considered in conjunction with the accompanying drawings.

BRIEF DESCRIPTION OF THE DRAWING

The single drawing FIGURE shows a sectional view of a grommet/seal and connector assembly constructed in accordance with the principals of the present invention.

DETAILED DESCRIPTION OF THE DRAWING

The single drawing FIGURES shows a cross-sectional view of a grommet/seal member 10 incorporated into a connector assembly which includes a connector body 12, a plurality of connector terminals 14 and a pair of electrical conductors 16. Grommet/seal member 10 is mounted in an opening 18 which is formed in wall 20 of a housing (not shown). For purposes of this discussion, connector body 12 will be considered to be located on the exterior of the housing, while conductors 16 extend through opening 18 into the interior of the housing. References to interior and exterior features are relative and may be reversed without departing from the spirit and scope of the present invention.

Grommet/seal member 10 comprises a first portion 22 which extends into opening 18 and which fills and matingly seals against the adjacent surfaces of opening 18. Portion 22 is provided with a flared portion 24 which extends outwardly from opening 18 adjacent a portion of an interior surface 26 of wall 20. Flared portion 24 secures the connector assembly in position within opening 18 and prevents removal of the connector assembly from opening 18 under normal operating conditions.

Grommet/seal member 10 has a second portion 28 which encapsulates terminal points 30 where conductors 16 are connected to terminals 14. In the embodiment shown, portion 28 of member 10 is molded to conform to a portion of connector body 12 defined by generally horizontal surface 31 and upstanding wall 32.

Grommet/seal member 10 is further provided with a portion 34 which connects portions 22 and 28. The cross-section of portion 34 is substantially larger than the cross-section of opening 18, is relatively flexible, and has a narrow cross section relative to the spacing between second portion 28 and housing 20. A surface 36 of portion 34 extends adjacent a portion of an exterior surface 38 of wall 20 to prevent grommet/seal member 10 from being pushed through opening 18 and into the housing.

As previously noted, termination points 30 are encapsulated by portion 28 of grommet/seal member 10. Conductors 16 extend from termination points 30 through portions 34 and 22 into the interior of the housing. Accordingly, conductors 16 are totally sealed to prevent the ingress of moisture and other contaminants along or through the conductors and into the housing. Conductors 16 are also protected by portion 22 from contact with the edge surfaces of opening 18. Such contact can cause damage to insulation resulting in short-circuits and other problems.

Member 10 is preferably formed by an injection molding process in which neoprene is injected into the area bounded by surface 31 and wall 32 of connector body 12 and around electrical conductors 16. A suitable mold is used to form the contours of member 10 in the areas not bounded by connector 12.

Grommet/seal member 10 is preferably molded as a unitary (one-piece) structure. First portion 22 of the resulting connector, grommet/seal and conductor assembly is then pressed into opening 18 to the final position shown. Member 10 is preferably formed of a relatively flexible material, such as neoprene. This allows the surfaces of portion 22 which are adjacent the surfaces of housing 20 to conform to those surfaces, insuring creation and maintenance of an effective seal. This structure also allows connector body 12 to "float" in a non-rigid manner so that the connector may be displaced, as indicated for example by arrow 40, for purposes of aligning with a mating connector assembly. Displacement of connector body 12 by a few thousandths of an inch is normally adequate. However, member 10 may be formed so as to allow more or less movement, if desired.

From the preceding description of the preferred embodiments, it is evident that the objects of the invention are attained. Although the invention has been described and illustrated in detail, it is to be clearly understood that the same is intended by way of illustration and example only and is not to be taken by way of limitation. The spirit and scope of the invention are to be limited only by the terms of the appended claims.

What is claimed is:

1. An arrangement for sealingly attaching a connector assembly to a housing and to an electrical conductor which extends through an opening in the housing, said connector assembly having a connector body and at least one terminal mounted in the connector body, said terminal being formed for connection to the electrical conductor at a connection point on the terminal spaced apart from the housing, the arrangement comprising a one-piece, non-rigid member having means which sealingly encloses the electrical conductor and the connection point, the non-rigid member having means for sealingly mounting the connector body to the housing so as to prevent the ingress of water and other contaminants into the housing, said means for sealingly mounting the connector body to the housing having a narrow cross section relative to the spacing between the connection point and the housing, and being flexible so as to allow the connector housing to be displaced for alignment with a mating connector assembly.

2. An arrangement according to claim 1, wherein said one-piece, non-rigid member has a first portion which extends into the opening in the housing, and a surface which matingly seals against an adjacent surface of the housing.

3. An arrangement according to claim 2, wherein said first portion has a flared end which extends adjacent an interior surface of the housing so as to prevent removal of the member from the opening.

4. An arrangement according to claim 2, wherein said one-piece, non-rigid member has a second portion, spaced apart from an exterior surface of the housing, said second portion lying adjacent the connector body and having a surface which matingly seals against an adjacent surface of the connector body.

5. An arrangement according to claim 4, wherein said one-piece, non-rigid member has a third portion, connecting said first and second portions, said third portion being relatively flexible and formed to allow the connector body to be moved slightly to either side for purposes of alignment with a mating connector assembly.

6. An arrangement according to claim 5, wherein the electrical conductor extends through the first and third portions, and the connection point is encapsulated by the second portion of the one-piece, non-rigid means.

7. An arrangement according to claim 5, wherein said third portion has a cross-section which is substantially larger than the opening, and a surface which extends adjacent an exterior surface of the housing so as to prevent the member from being pushed through the opening in the housing.

8. An arrangement according to claim 1, wherein said one-piece, non-rigid member is formed of a molded material, such as neoprene.

9. A grommet/seal member for sealing an opening in a housing and for sealing and protecting an electrical conductor which extends through the opening in the housing, comprising:

a first portion which extends into the opening in the housing and which has a surface which matingly seals against an adjacent surface of the housing;

a second portion, spaced apart from the opening in the housing and encapsulating an exposed end of the electrical conductor; and a third portion, one-piece with and connecting said first and second portions, said third portion being relatively flexible and having a narrow cross section relative to the spacing between the second portion and the housing so as to allow the second portion to be laterally displaced relative to the first portion and the housing for alignment with a mating connector assembly.

10. A grommet/seal member according to claim 9, wherein said grommet/seal member comprises a one-piece structure formed of a molded, non-rigid material such as neoprene.

11. A grommet/seal member according to claim 9, wherein said first portion has a flared end which extends adjacent an interior surface of the housing so as to prevent removal of the grommet/seal member from the opening.

12. A grommet/seal member according to claim 9, wherein said third portion has a cross-section which is substantially larger than the opening, and a surface which extends adjacent an exterior surface of the housing so as to prevent the grommet/seal member from being pushed through the opening in the housing.

13. A connector assembly for attachment to a housing, comprising:

a connector body having at least one terminal;

an electrical conductor connected to the terminal at a connection point near the connector body, said conductor extending away from the connection point through an opening in the housing; and a one-piece, molded grommet/seal member which encapsulates the connection point and at least a portion of the electrical conductor, and which is provided with means for sealingly mounting the connector assembly to the opening in the housing so as to prevent the ingress of water and other contaminants through the opening and along the conductors; said connection point being spaced apart from the housing; and said means for mounting the connector assembly having a narrow cross section relative to the spacing between the connection point and the housing, and being flexible so as to allow the connector body to be laterally displaced and aligned with a mating connector assembly.

14. A connector assembly according to claim 13, wherein said one-piece, molded grommet/seal member is molded from a material such as neoprene.

* * * * *